US008376004B1

(12) United States Patent
Nieto

(10) Patent No.: US 8,376,004 B1
(45) Date of Patent: Feb. 19, 2013

(54) SPILL-STOPPING DEVICE FOR CHEMICAL DRUMS

(76) Inventor: Roberto J. Nieto, Alsip, IL (US)

( * ) Notice: Subject to any disclaimer, the term of this patent is extended or adjusted under 35 U.S.C. 154(b) by 362 days.

(21) Appl. No.: 12/860,352

(22) Filed: Aug. 20, 2010

(51) Int. Cl.
*B65B 1/04* (2006.01)

(52) U.S. Cl. ..... 141/370; 141/350; 141/372

(58) Field of Classification Search ..... 141/93, 141/97, 312, 348, 349, 350, 368, 370, 372, 141/374
See application file for complete search history.

(56) References Cited

U.S. PATENT DOCUMENTS

| | | | | |
|---|---|---|---|---|
| 2,243,451 | A | 5/1941 | Bauer | |
| 2,763,419 | A * | 9/1956 | Brown et al. | 141/94 |
| 2,832,378 | A * | 4/1958 | Beavon | 141/287 |
| 3,306,323 | A | 2/1967 | Aronson | |
| 4,312,388 | A * | 1/1982 | Hager et al. | 141/1 |
| 4,878,797 | A | 11/1989 | Lonardi | |
| D341,147 | S | 11/1993 | Pollak | |
| 5,262,578 | A * | 11/1993 | Hall | 588/249 |
| 5,267,591 | A * | 12/1993 | Wakabayashi et al. | 141/90 |
| 6,698,473 | B2 | 3/2004 | Decarne | |
| 6,701,979 | B2 | 3/2004 | Servadei et al. | |
| 6,701,982 | B1 * | 3/2004 | Ortiz et al. | 141/392 |

* cited by examiner

*Primary Examiner* — Gregory Huson
*Assistant Examiner* — Jason Niesz

(57) ABSTRACT

A spill-stopping device for a chemical drum featuring a boot assembly; a shroud with an aperture disposed on the first end of the boot assembly, the aperture is adapted to accept a shaft of a filling machine; a spout disposed in the second end of the boot assembly, the spout is adapted to snugly fit into chemical drum aperture in a lid of a chemical drum and accept a shaft of a filing machine; a double-door assembly pivotally attached in the spout via hinges, the double-door assembly can move between at least an open position and a closed position respectively allowing and preventing access to the spout from the boot assembly; and counterweights attached to each hinge and extending upwardly into the boot assembly, the counterweights function to bias the double-door assembly in the closed position.

3 Claims, 5 Drawing Sheets

SPILL-STOPPING DEVICE FOR CHEMICAL DRUMS

FIELD OF THE INVENTION

The present invention is directed to a device for preventing spills in a chemical drum.

BACKGROUND OF THE INVENTION

Chemical spills are often extremely dangerous. The present invention features a spill-stopping device for chemical drums to help prevent chemical spills, for example when using a lance-type filling machine for chemical drums.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

Figure 1:
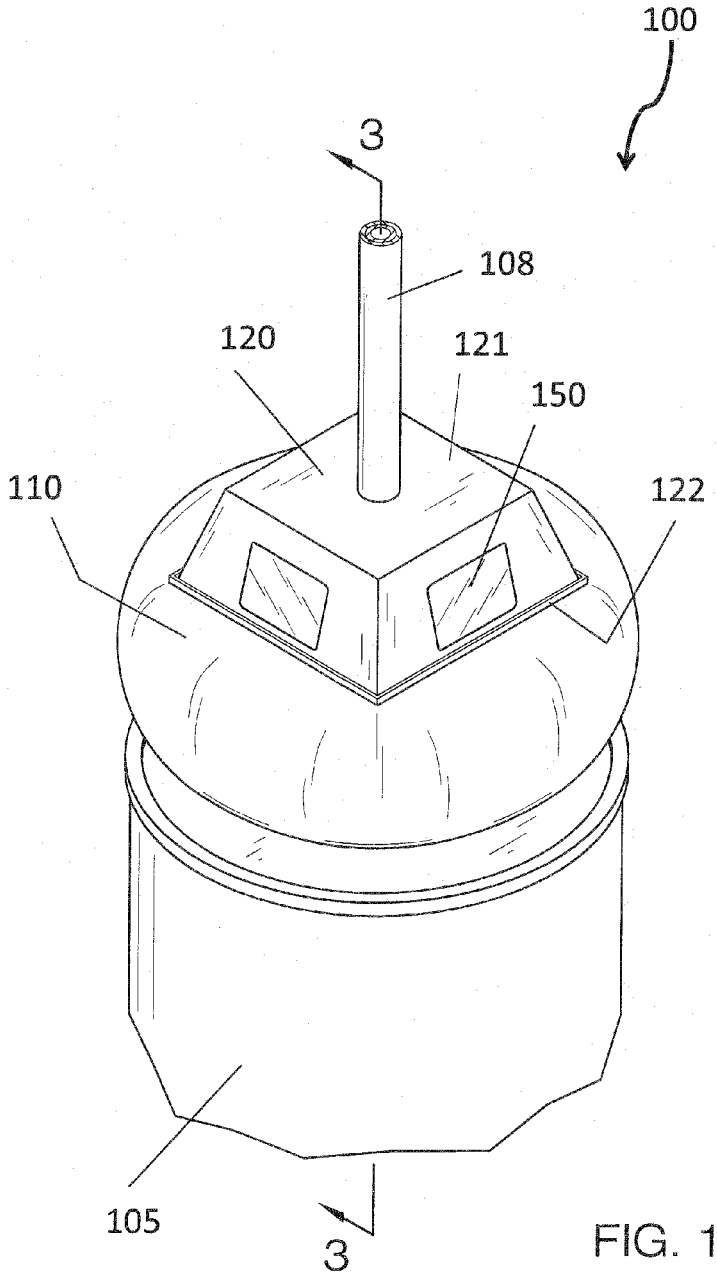
FIG. 1 is a perspective view of the spill-stopping device of the present invention.

The present invention features a spill-stopping device for chemical drums to help prevent chemical spills. In some embodiments, the spill-stopping device comprises a generally hollow boot assembly having a first end and a second end; a generally hollow shroud disposed on the first end of the boot assembly, an aperture is disposed in a top end of the shroud, the aperture is adapted to accept a shaft of a filling machine; a generally hollow spout disposed in the second end of the boot assembly, the spout is adapted to snugly fit into chemical drum aperture in a lid of a chemical drum, the spout is adapted to accept a shaft of a filing machine; a double-door assembly disposed in the spout, the double-door assembly comprises a first half door and a second half door, the first half door is pivotally attached to an intersection of the spout and the second end of the boot assembly via a first hinge and the second half door is pivotally attached to an intersection of the spout and the second end of the boot assembly via a second hinge, the double-door assembly can move between at least an open position and a closed position respectively allowing and preventing access to the spout from the boot assembly; and a first counterweight attached to the first hinge and extending upwardly into the boot assembly, and a second counterweight attached to the second hinge and extending upwardly into the boot assembly, the counterweights function to bias the double-door assembly in the closed position.

In some embodiments, the boot assembly is generally spherical or ellipsoidal in shape. In some embodiments, the shroud comprises one or more windows disposed on a side.

DESCRIPTION OF PREFERRED EMBODIMENTS

Referring now to FIGS. 1-5, the present invention features a spill-stopping device 100 for attaching to a chemical drum 105. The spill-stopping device 100 can help contain spills, for example when using a lance-type filling machine for chemical drums.

The device 100 of the present invention comprises a generally hollow boot assembly 110 for attaching to a chemical drum 105. The boot assembly 110 is generally spherical or ellipsoidal in shape, having a first end 111 and a second end 112. The second end 112 is adapted to fit onto the lid 106 of the chemical drum 105.

Attached (e.g., removably attached) to the first end 111 of the boot assembly 110 is a shroud 120. The shroud 120 may be cylindrical in shape, in the shape of a cross section of a cone, or another shape. For example, the shroud 120 has a top 121, a bottom 122, and a side. In some embodiments, the diameter of the top is less than that of the bottom.

In some embodiments, the shroud 120 is generally hollow. In some embodiments, the shroud 120 comprises one or more windows 150 disposed on its side. In some embodiments, the shaft 108 of a filling machine is driven through an aperture in the top 121 of the shroud 120 and then into (and through) the boot 110.

Figure 2:
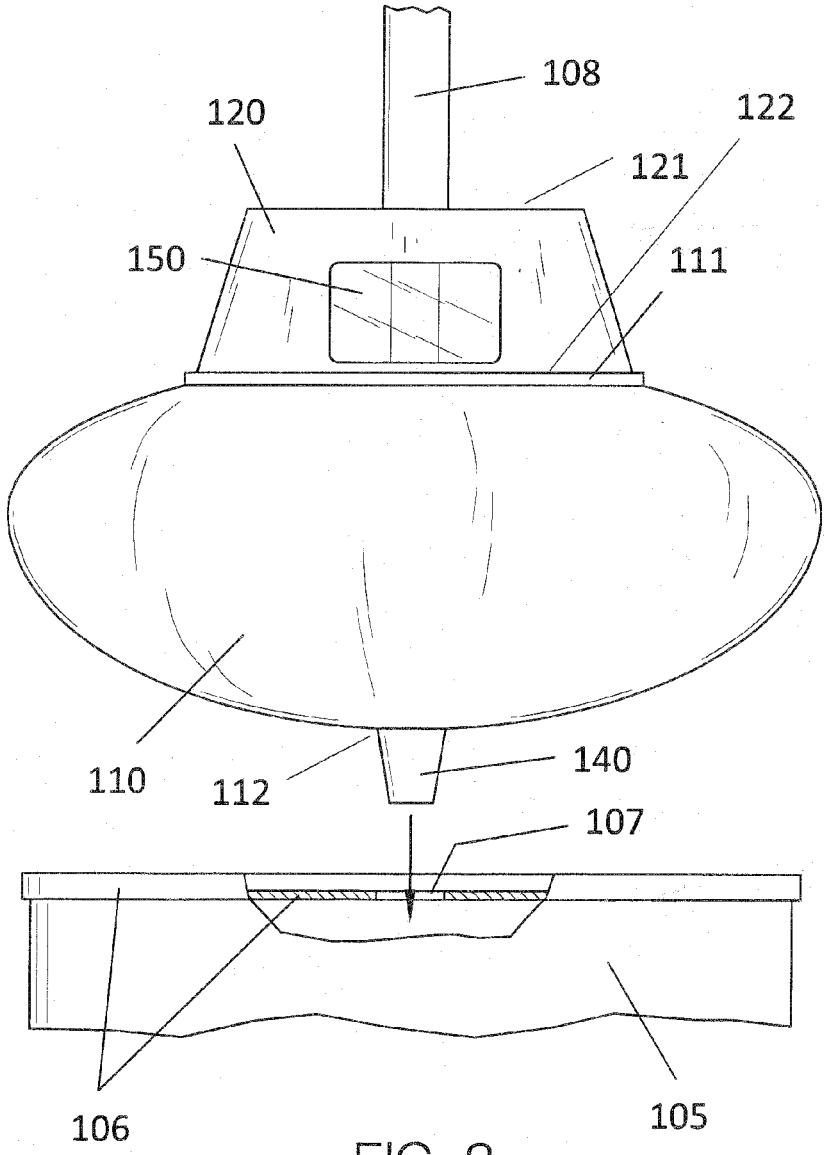
FIG. 2 is a side view of the spill-stopping device of FIG. 1.
Figure 3:
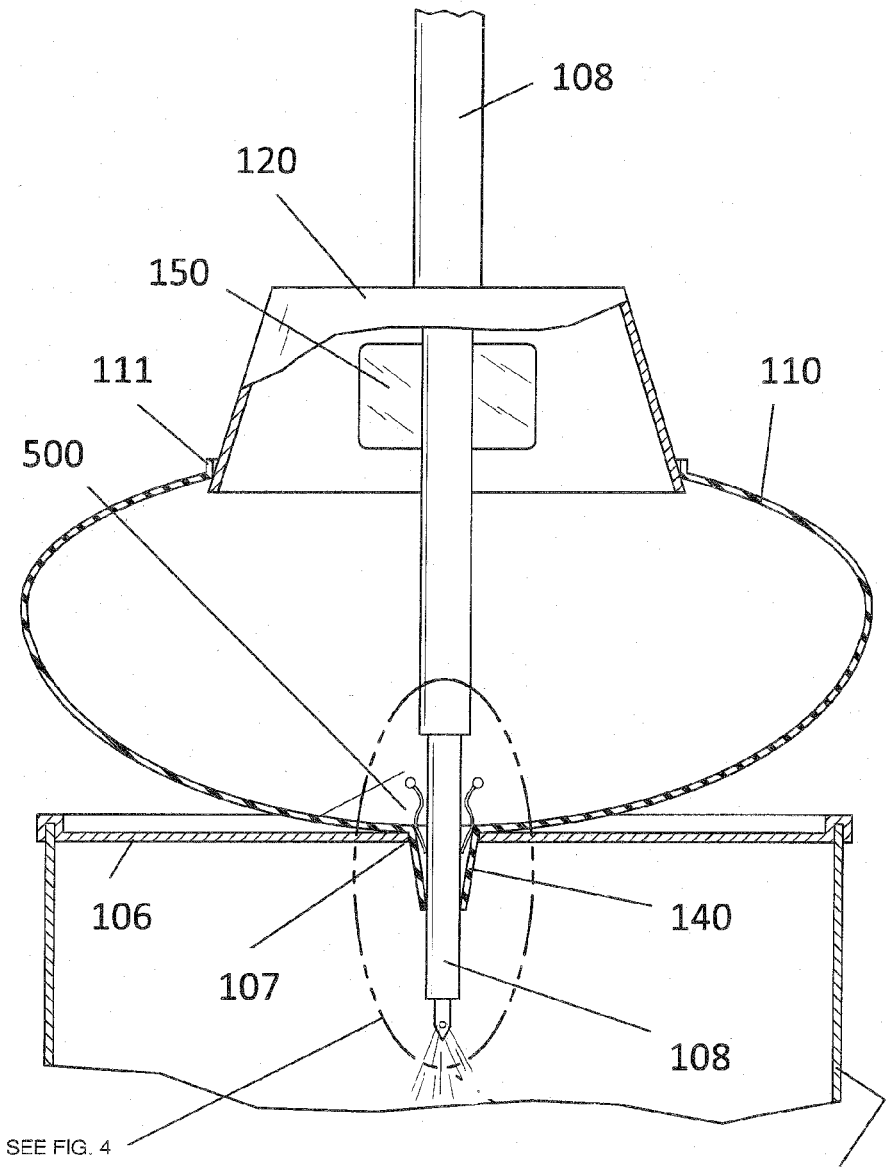
FIG. 3 is a side cross sectional view of the spill-stopping device of FIG. 1.

As shown in FIG. 2, a spout 140 (a generally hollow 140) is disposed in the second end 112 of the boot assembly 110. The spout 140 is for snugly fitting into the aperture 107 in the lid 106 of the chemical drum. The shaft 108 of a filling machine is driven through the boot 110, through the spout 140 and into the chemical drum 105 (see FIG. 3).

Figure 4:
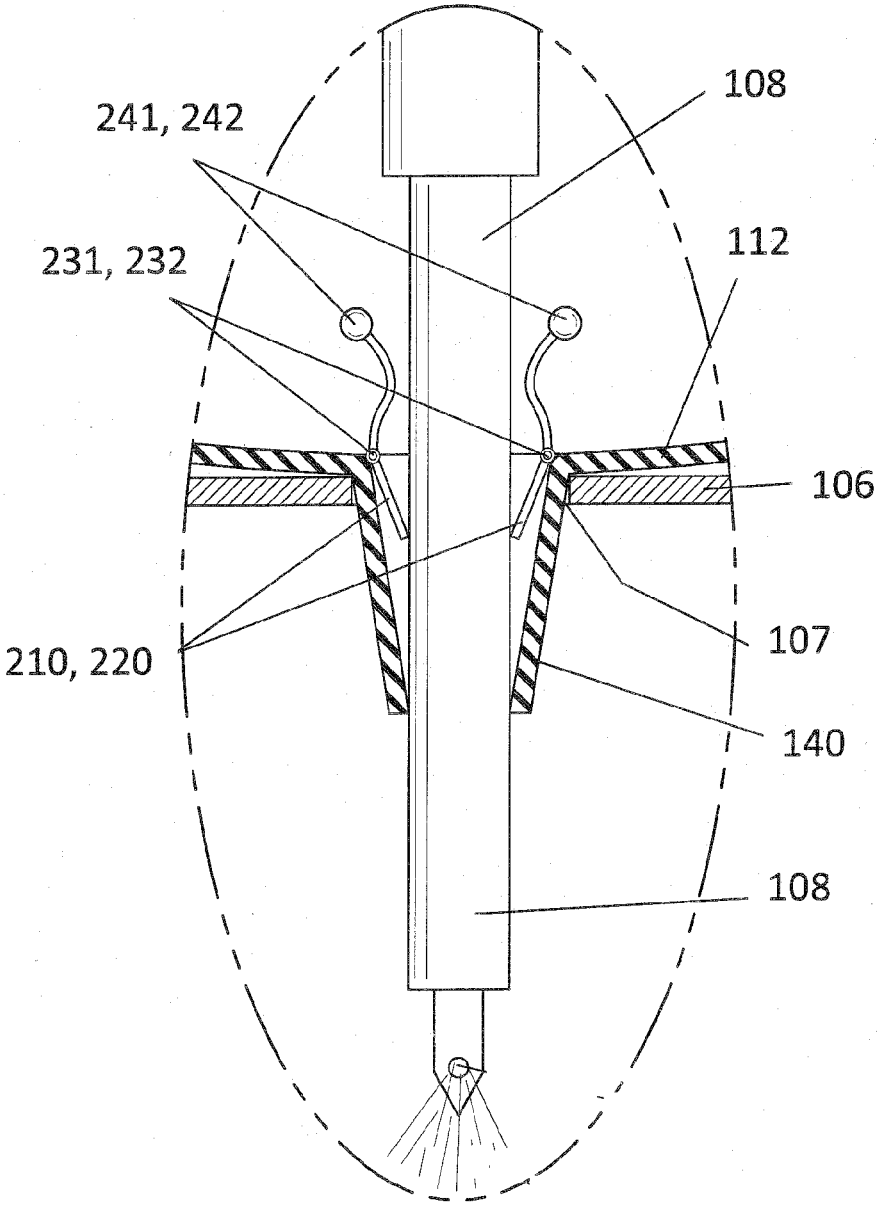
FIG. 4 is a first exploded view of the double door assembly of the spill-stopping device of FIG. 3.
Figure 5:
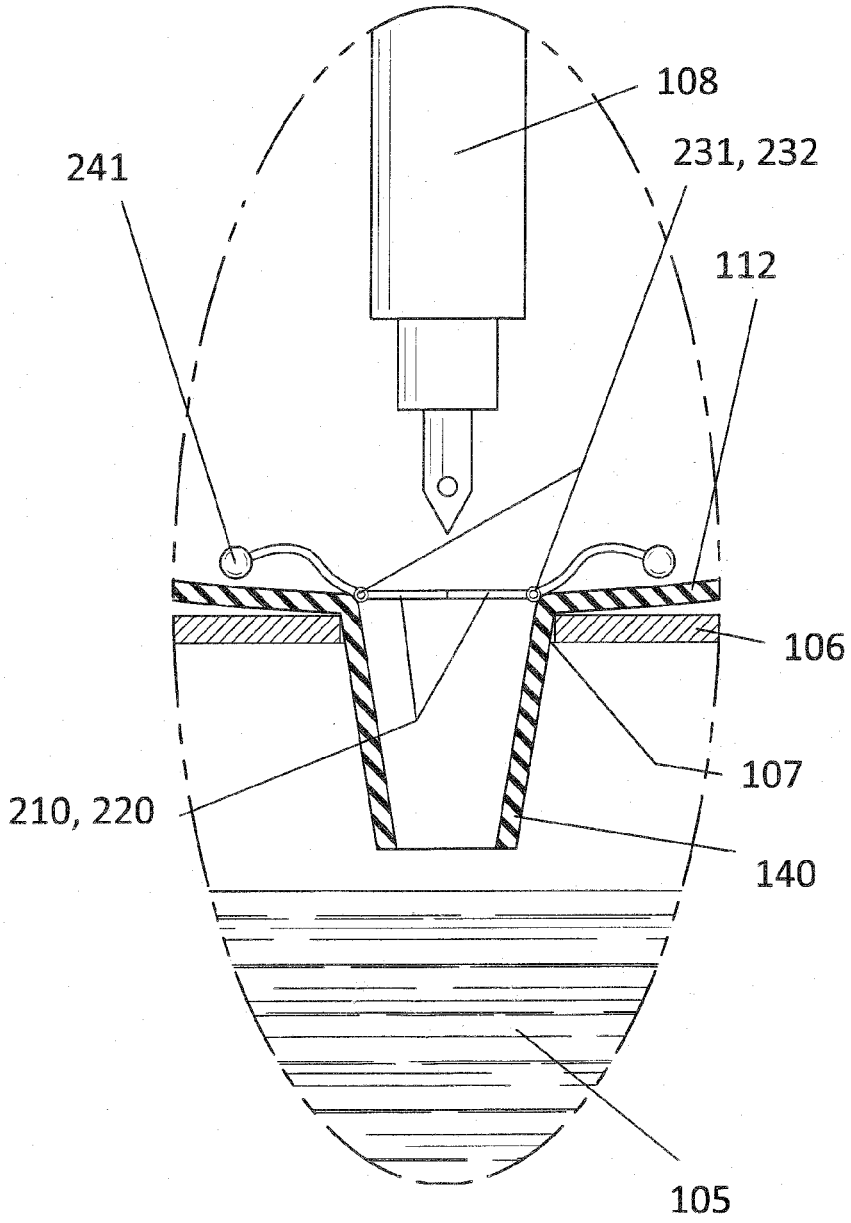
FIG. 5 is a first exploded view of the double door assembly of the spill-stopping device of FIG. 3.

As shown in FIG. 4 and FIG. 5, a double-door assembly 500 is disposed in the spout, for example in the spout 140 where the spout 140 and the second end 112 of the boot assembly 110 attaches to the spout 140. The door assembly comprises a first half door 210 and a second half door 220. The first half door 210 is pivotally attached to the spout 140 (e.g., where the spout 140 is connected to the second end 112 of the boot assembly 110) via a first hinge 231. The second half door 220 is pivotally attached to the spout 140 via a second hinge 232.

The double door assembly 500 can be moved between an open position and a closed position. In the open position, the first half door 210 and the second half door 220 open into the spout 140 (see FIG. 4). In the closed position, the first half door 210 and second half door 220 are flush with the second end 112 of the boot assembly 110, closing off access to the spout 140 from the boot assembly 110 (see FIG. 5).

Attached to the first hinge 231 and extending upwardly into the boot assembly 110 is a first counterweight 241 and attached to the second hinge 232 and extending upwardly into the boot assembly 110 is a second counterweight 242. The counterweights function to bias the double door assembly in the closed position. When the shaft 108 of the filling machine is inserted though the boot, it is pushed through the double door assembly and into the spout 140. When the shaft 108 is removed from the spout 140, the counterweights cause the double door assembly to move back to the closed position.

The boot assembly 110 may be constructed from a variety of materials and in a variety of sizes. For example, in some embodiments, the boot assembly 110 is constructed from a material comprising rubber. In some embodiments, the boot assembly 110 is about 24 inches in diameter (at the widest part). In some embodiments, the boot assembly 110 is about 10 inches tall as measured from the first end 111 to the second end 112.

The following the disclosures of the following U.S. Patents are incorporated in their entirety by reference herein: U.S. Pat. No. 3,306,323; U.S. Pat. No. 2,243,451; U.S. Pat. No. 6,698,473; U.S. Pat. No. 5,878,797; U.S. Pat. No. 6,701,979; U.S. Design Pat. No. 341,147.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A spill-stopping device comprising:

(a) a generally hollow boot assembly having a first end and a second end;

(b) a generally hollow shroud disposed on the first end of the boot assembly, an aperture is disposed in a top end of the shroud, the aperture is adapted to accept a shaft of a filling machine;

(c) a generally hollow spout disposed in the second end of the boot assembly, the spout is adapted to snugly fit into chemical drum aperture in a lid of a chemical drum, the spout is adapted to accept a shaft of a filing machine;

(d) a double-door assembly disposed in the spout, the double-door assembly comprises a first half door and a second half door, the first half door is pivotally attached to an intersection of the spout and the second end of the boot assembly via a first hinge and the second half door is pivotally attached to an intersection of the spout and the second end of the boot assembly via a second hinge, the double-door assembly can move between at least an open position and a closed position respectively allowing and preventing access to the spout from the boot assembly; and (e) a first counterweight attached to the first hinge and extending upwardly into the boot assembly, and a second counterweight attached to the second hinge and extending upwardly into the boot assembly, the counterweights function to bias the double-door assembly in the closed position.

2. The spill-stopping device of claim 1, wherein the boot assembly is generally spherical or ellipsoidal in shape.

3. The spill-stopping device of claim 1, wherein the shroud comprises one or more windows disposed on a side.

* * * * *